United States Patent [19]

Berlant

[11] Patent Number: 4,860,982

[45] Date of Patent: Aug. 29, 1989

[54] CONTAINER SUPPORT

[76] Inventor: Sigmund Berlant, 1332 NW. 14 Ave., Pompano Beach, Fla. 33069

[21] Appl. No.: 754,119

[22] Filed: Jul. 12, 1985

[51] Int. Cl.[4] ..... B65B 67/04

[52] U.S. Cl. ..... 248/100

[58] Field of Search ..... 248/153, 302, 95, 99, 248/100, 101

[56] References Cited

U.S. PATENT DOCUMENTS

| | | | |
|---|---|---|---|
| 228,733 | 6/1880 | Curtis | 248/99 |
| 2,188,047 | 1/1940 | Jones | 248/99 |
| 2,213,929 | 9/1940 | Hoffman | 248/99 |
| 2,235,182 | 3/1941 | Weston | 248/100 |
| 2,527,746 | 10/1950 | Lawrence | 248/100 |
| 3,253,812 | 5/1966 | Okazaki | 248/97 |
| 3,313,504 | 4/1967 | Stoltze | 248/99 |
| 3,779,419 | 12/1973 | Heitz | 248/99 |
| 3,861,125 | 1/1975 | Hagemeister | 248/99 |
| 3,893,649 | 7/1975 | Cornell | 248/99 |
| 4,332,361 | 6/1982 | McClellan | 248/95 |
| 4,376,520 | 3/1983 | Wetherington | 248/97 |
| 4,398,689 | 8/1983 | Prader | 248/99 |
| 4,469,300 | 9/1984 | Valekso | 248/97 |
| 4,498,652 | 2/1985 | Malik | 248/99 |

*Primary Examiner*—J. Franklin Foss
*Assistant Examiner*—Robert A. Olson
*Attorney, Agent, or Firm*—Sughrue, Mion, Zinn, Macpeak & Seas

[57] ABSTRACT

A container support is provided and having a first component attached to a flat surface and a second component spaced a distance from the first component and in alignment therewith and also attached to a flat surface. The components are equally structured and have arms for attaching the same to a flat surfaces. The components have wells for receiving the handles of a container whereby the container is supported therein. The flat surfaces may be the inside walls of a cabinet such that when the cabinet door is closed the container which functions to receive articles to be discarded is concealed.

2 Claims, 3 Drawing Sheets

CONTAINER SUPPORT

BACKGROUND OF THE INVENTION

1. Field of the Invention

This invention relates to container supports in general and plastic bag supports attached to the inside wall of a cabinet door in particular.

2. Background of the Prior Art

The prior art discloses bag stands having base supports on which the stands rest. The present invention does not use base supports as the invention is secured on the inside wall of a cabinet door.

SUMMARY OF THE INVENTION:

This invention pertains to container supports which are inexpensive to manufacture and simple to install.

It is a feature of this invention to provide a container support which comprises two equal components having wells in which the handles of a container rest.

It is another feature of this invention to provide a container support comprising two equal components having wall engaging arms with means to fasten said arms to a flat surface.

It is still another feature of this invention to provide a container support having two equal components with horizontal members having bends with piercing edges to pierce non-metallic atrticles.

And yet another object of this invention is to provide a container support comprising two equal components each of which comprises wall engaging arms having flattened areas with holes to receive fasteners for attaching said arms to a flat surface, wells for receiving the handles of a container and horizontal members having piercing edges for piercing non-metallic objects.

Still another object of the invention is to provide a container support having terminal edges which support a tubular rod, which tubular rod may support various household articles.

These and other objects of the invention will be found in the detailed description of the drawings hereinafter.

Figure 1:
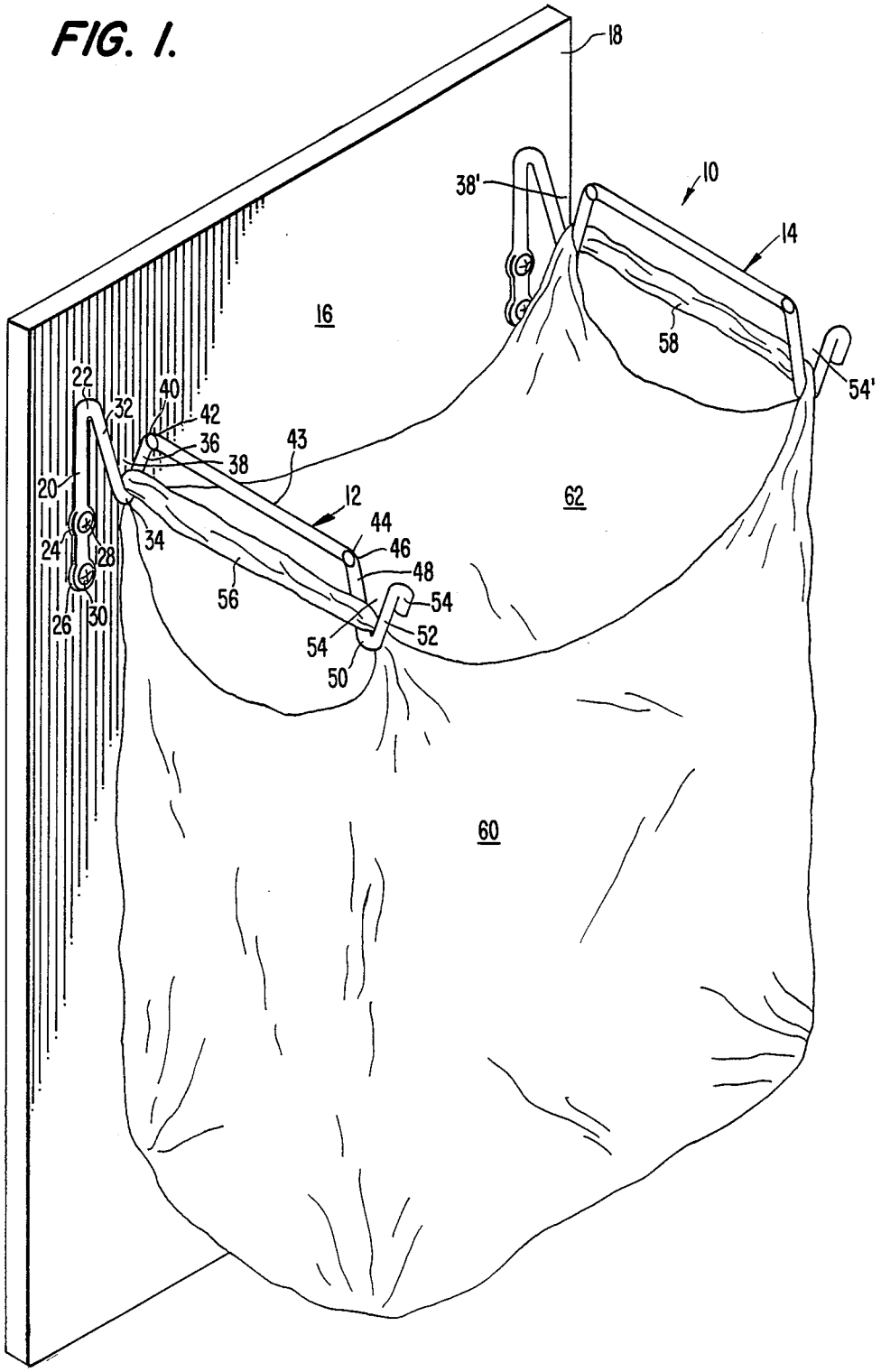
FIG. 1 is a perspective view of a container support such as a shopping bag which comprises two equal components attached to a flat surface such as the inside wall of a cabinet door.
Figure 3:
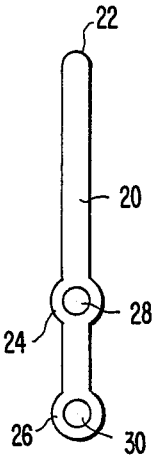
FIG. 3 is a side view of the surface engaging arm showing flattened areas in which there are holes to receive fasteners.
Figure 2:
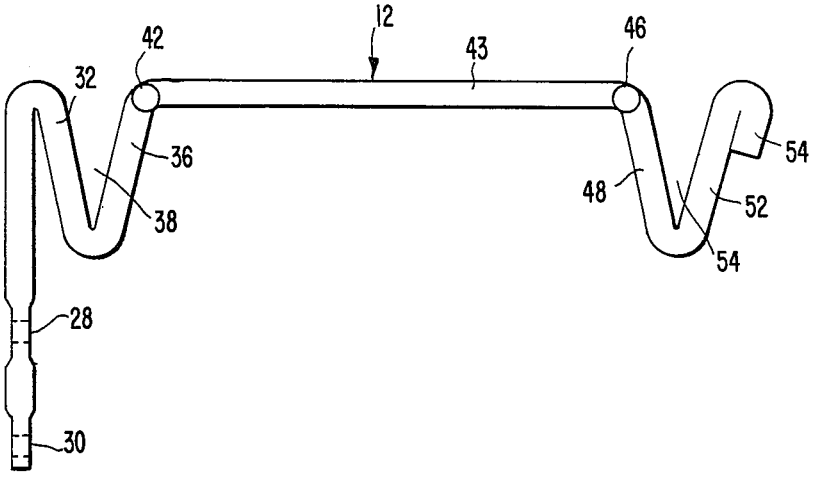
FIG. 2 is a perspective view of one of the two components having a surface engaging arm, wells for receiving the handles of a container such as a shopping bag and a horizontal rod with bends having piercing edges thereon.
Figure 5:
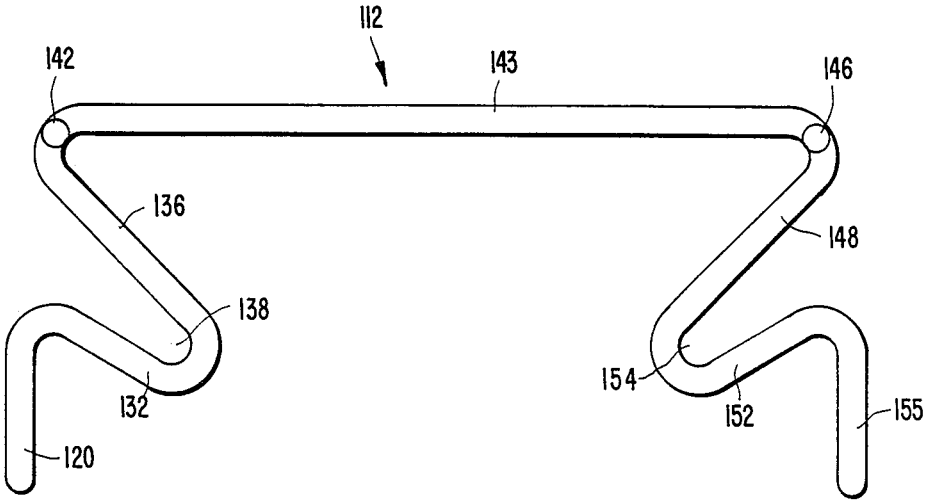
FIG. 5 is an end view of one of the components of figure 4.

DESCRIPTION OF THE PREFERRED EMBODIMENT OF THE INVENTION:

Referring now in more detail to the drawings, FIG. 1 shows a container support 10 which comprises two equal components 12 and 14 attached in spaced apart relationship to a flat surface such as the inside wall 16 of a cabinet door 18. As each of the components are structurally equal, only one will be described in detail.

Component 12 has an arm 20, which in this view is vertical but may be horizontal, having bend 22 at one end and flattened areas 24 and 26 at the other end. The flattened ends 24 and 26 have holes therein to receive fasteners 28 and 30 by which the component 12 is attached to a surface such as the inside surface 16 of a cabinet door 18. Extending at an angle from the bend 22 is an arm 32 having a bend 34 and an upwardly extending arm 36. The area between the arm 32 and 36 define wells 38. The arm 36 has a bend 40 which is formed into a piercing edge 42 for piercing non-metallic objects such as paper, plastic or cloth objects. Extending away from the bend 40 is a horizontal bar 43 having a bend 44 distal from the bend 40 which also has a piercing point 46. Extending away from the bend 44 and at an angle thereto is an arm 48 having a bend 50 distal from the bend 46. An arm 52 extends away at an angle from the bend 50. The area between arms 48 and 52 define wells 54. The arm 52 has a terminal end 54. As will be appreciated, the wells 38 and 54 support the handles of a container such as a typical shopping bag 60.

As will be readily understood from FIG. 1, the components 12 and 14 are attached to a surface such as the inside surface 16 of a cabinet door 18 in spaced apart relationship. The handles 56 and 58 of a typical shopping bag 60 are received in the wells 38 and 54 of component 12 and wells 38 and 54 of component 14 whereby the bag 60 is supported in an open condition as shown. Waste matter is inserted into the open end 62. The door 18 is closed thereby concealing the bag and its contents.

Figure 4:
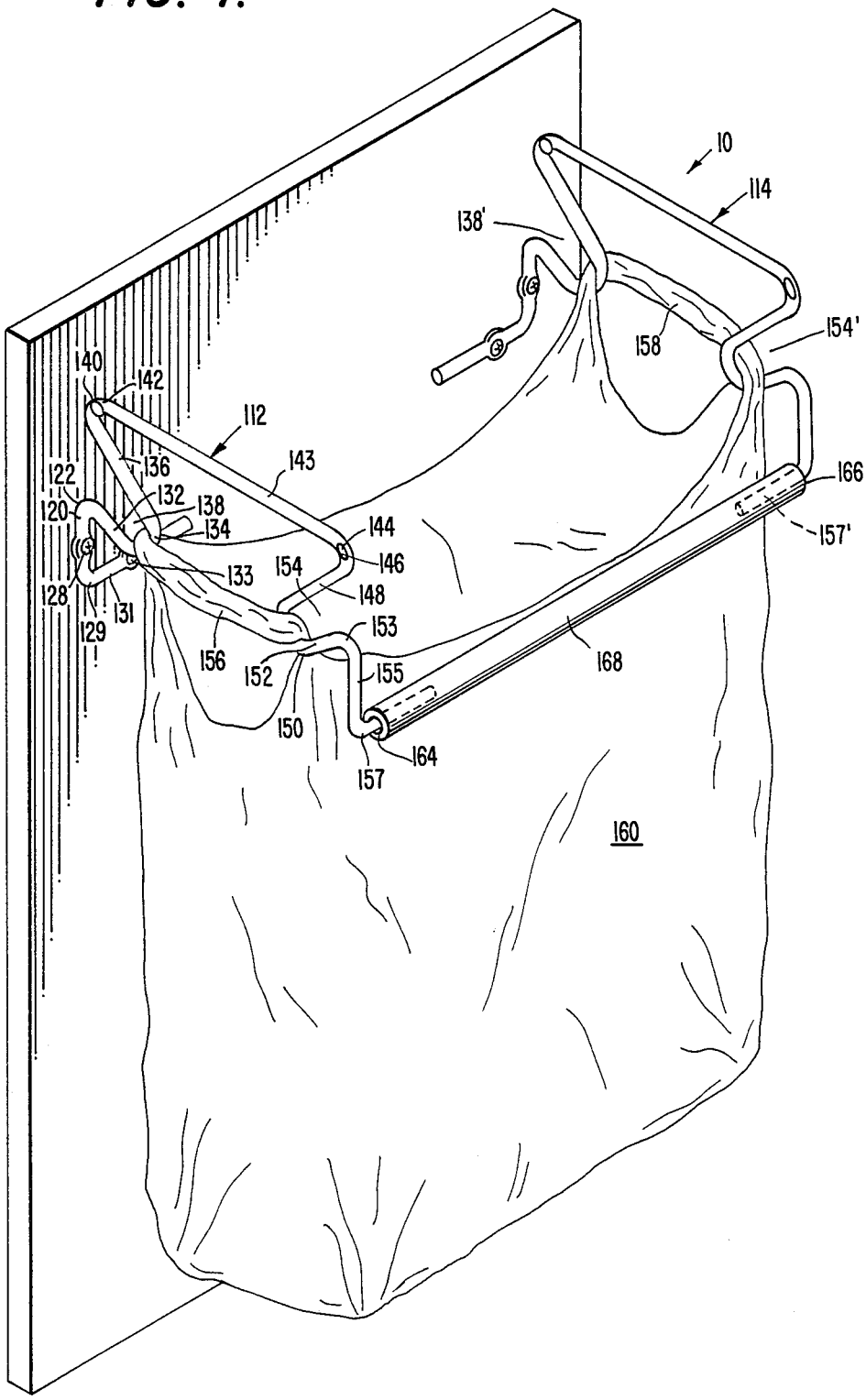
FIG. 4 is a perspective view of a modified form of the invention showing a horizontal rod member attached to terminal ends of the components, said rod adapted to hold various household articles.

FIG. 4 shows a modified form of the invention 10 having two equal components 112 and 114. As the components are structurally equal, one will be described.

Component 112 has an arm 120, which in this view is vertical but may be horizontal, having a bend 122 and a fastener 128 extending through a hole in the arm 120. Below the fastener 128 is a bend 129 and extending away from the bend 129 is an arm 131 having a fastener 133 extending through a hole in the arm 131.

Extending away at an angle from the bend 122 is an arm 132 which has a bend 134. Extending away from the bend 134 and at an angle thereto is an arm 136 having a bend 140 at an end thereof. The bend 140 has a piercing edge 142. A bar 143 extends away from the bend 140 and it has a bend 144 distal from the bend 142. The bend 144 is in the form of a piercing edge 146. An arm 148 extends away from the bend 144 and at an angle thereto and it has a bend 150, away from which at an angle thereto extends an arm 152 having a bend 153. An arm 155 extends away from the bend 153 and it has a terminal end 157.

Wells 138 and 154 are defined between arms 132, 136 and 148 and 155 which receive the handle 156 of a container such as a plastic bag 160.

Component 114 is identical to 112 and has wells 138' and 154' which receive the handle 158 of a plastic bag 160. Component 114 has a terminal end 157' identical to terminal end 157 of component 112.

Terminal ends 157 and 157' receive the open ends 164 and 166 of a rod 168 which functions to support various household articles.

While the invention has been described with regard to a preferred embodiment thereof, it will be appreciated to those skilled in the art that modifications and variations of the preferred embodiment may be made therein without departing from the scope and spirit of the invention as described by the following claims.

What I claim is:

1. A container support comprising:

a first component having a vertical arm attached at one end to a vertical surface;

a second arm extending downwardly and away from said vertical arm to form an angle of less than 90 degrees therebetween;

a third arm extending upwardly and away from said second arm to form an angle of less than 90 degrees therebetween;

a horizontal rod extending away from said third arm to a distal end;

a fourth arm extending downwardly and away from said distal end;

an fifth arm extending upwardly and away from said fourth arm to form an angle of less than 90 degrees therebetween;

a first handle of a container positioned between said second and said third arms and said fourth and said fifth arms;

a second component equally structured as the first component and spaced a distance therefrom in alignment therewith and also having a vertical arm attached to a flat surface and second and third arms and fourth and fifth arms identical to the second and third arms and the fourth and fifth arms of said first component; and a second handle of the container positioned between said second and third arms and said fourth and fifth arms of said second components.

2. A container support according to claim 1, and:

piercing edges on said horizontal rods adjacent said third and fourth arms to pierce holes in containers having no handles thereon.--

* * * * *